US006951485B2

(12) United States Patent
Lin et al.

(10) Patent No.: US 6,951,485 B2
(45) Date of Patent: Oct. 4, 2005

(54) AD ADAPTER MODULE

(75) Inventors: Shih-An Lin, Tucheng (TW); Tsuo Chun-Jung, Taoyuan (TW)

(73) Assignee: Benq Corporation, Taoyuan Shien (TW)

( * ) Notice: Subject to any disclaimer, the term of this patent is extended or adjusted under 35 U.S.C. 154(b) by 0 days.

(21) Appl. No.: 10/939,364

(22) Filed: Sep. 14, 2004

(65) Prior Publication Data

US 2005/0059298 A1 Mar. 17, 2005

(30) Foreign Application Priority Data

Sep. 16, 2003 (TW) ..... 92125541 A

(51) Int. Cl.[7] ..... H01R 13/648
(52) U.S. Cl. ..... 439/607; 361/799
(58) Field of Search ..... 439/607, 98, 92, 439/99, 76.1; 361/799, 753

(56) References Cited

U.S. PATENT DOCUMENTS 5,805,429 A * 9/1998 Andersson ..... 361/799
5,980,313 A * 11/1999 Kunishi et al. ..... 439/545
6,008,994 A * 12/1999 Bates ..... 361/737
6,078,504 A * 6/2000 Miles ..... 361/727
6,252,160 B1 * 6/2001 Chang et al. ..... 174/35 R
6,282,097 B1 * 8/2001 Minelli et al. ..... 361/728
6,679,731 B2 * 1/2004 Chang ..... 439/609
6,755,686 B2 * 6/2004 Scherer et al. ..... 439/564
6,780,043 B2 * 8/2004 Malmberg ..... 439/377
6,875,052 B1 * 4/2005 Lo et al. ..... 439/564

FOREIGN PATENT DOCUMENTS

TW 357948 5/1999
TW 511809 11/2002

* cited by examiner

*Primary Examiner*—Gary Paumen
*Assistant Examiner*—Phuongchi Nguyen
(74) *Attorney, Agent, or Firm*—Rabin & Berdo, PC

(57) ABSTRACT

An AD adapter module including an AD adapter device, a socket, shielding case and a supporting part. The socket has a lateral side with a side protrusion on the lateral side, and is installed on the AD adapter device. The shielding case has a hole penetrating through the shielding case. The AD adapter device is disposed within the shielding case with the lateral side and side protrusion of the socket exposed from the hole. The supporting part has a securing protrusion and is disposed on the shielding case. The securing protrusion penetrates through the hole of the shielding case so the securing protrusion makes contact with the side protrusion and the shielding case. When a plug is inserted into the socket, the securing protrusion of the supporting part is pushed against the side protrusion of the socket.

10 Claims, 9 Drawing Sheets

AD ADAPTER MODULE

This application claims the benefit of Taiwan application Serial No. 92125541, filed on Sep. 16, 2003, the subject matter of which is incorporated herein by reference.

BACKGROUND OF THE INVENTION

1. Field of the Invention

The invention relates in general to an AD adapter module, and more particularly to an AD adapter module capable of transforming an AC power into a DC power for a flat panel display.

2. Description of the Related Art

A power board module is a type of AD adapter modules and has the advantages of small size and low cost. In the current flat panel display, such an AD adapter module is utilized to transform AC power into DC power and to serve as a power supply.

FIG. 1 is a schematic illustration showing a conventional power board module 10, which mainly includes a power board 101, a socket 103, and a shielding case 105.

The socket 103 is welded to the power board 101. The shielding case 105 has a hole 1050 penetrating the shielding case 105. The power board 101 is disposed within the shielding case 105 with the socket 103 being exposed from the hole 1050.

The shielding case 105 serves as a shield for shielding the low-frequency electric field radiation generated by the power board 101. In addition to the power board 101, other electrical elements such as logic circuit boards and the like may also be disposed in the shielding case 105. These electrical elements may be disposed at suitable positions in the flat panel display through the shielding case 105 fastened to the flat panel display.

As shown in FIG. 1, the dimension of the shielding case 105 in the X1 direction is about equal to that of the power board 101 in the X1 direction owing to the limitation of electrical and structural design.

In the process of combining the power board 101 with the shielding case 105, the power board 101 is first placed into the shielding case 105. Then, the power board 101 is slightly tilted to make the socket 103 and the connectors 107*a* and 107*b* entering the holes 1050, 1052*a*, and 1052*b*, respectively. Next, the power board 101 is rotated to be horizontal so the power board 101 can be fastened to the shielding case 105.

In order to respectively expose the socket 103 and the connectors 107*a* and 107*b* from the holes 1050, 1052*a* and 1052*b*, the holes 1050, 1052*a* and 1052*b* are configured to be larger than the socket 103 and the connectors 107*a* and 107*b*. Taking the socket 103 as an example, the reason why the hole 1050 is made larger is to make the socket 103, which is in the same tilted state as the power board 101, be smoothly inserted into the hole 1050. However, when the power board 101 is fastened to the shielding case 105 in the horizontal state, a gap 1054 is left between the external side of the socket 103 and the hole 1050.

FIG. 2 is a schematic illustration of the assembled power board 101 and shielding case 105. FIG. 2 is a cross-sectional view taken along a line passing through the combination of the socket 103 and the shielding case 105 in FIG. 1 and is further combined with the power board 101 in FIG. 1, which is then rotated 180 degrees along the X1 direction.

In the assembled power board module 10, the socket 103 is exposed from the hole 1050, and a gap 1054 is left between the socket 103 and the shielding case 105. Hence, when the plug of the power line is inserted into the socket 103 along the X1 direction, corresponding stress is imposed on the welded portion 109 between the socket 103 and the power board 101. Consequently, if the stress on the plug exceeds the strength of the welded portion 109, cracks will occur in the welded portion 109 between the socket 103 and the power board 101. Thus, the module may be short-circuited and the flat panel display cannot operate.

SUMMARY OF THE INVENTION

It is therefore an object of the invention to provide an AD adapter module capable of preventing the solder crack, which is caused owing to an excess of stress imposed on portions between the socket and the AD adapter device that are welded together.

The invention achieves the above-identified object by providing an AD adapter module that includes an AD adapter device, a socket, a shielding case, and a supporting part. The socket is disposed on the AD adapter device and has a lateral side with a side protrusion on the lateral side. The shielding case has a hole penetrating the shielding case. The AD adapter device is disposed within the shielding case with the lateral side of the socket and the side protrusion exposed from the hole. The supporting part has a securing protrusion disposed on the shielding case. The securing protrusion inserted into the hole of the shielding case makes contact with the shielding case and the side protrusion. When a plug is inserted into the socket, the side protrusion of the socket is pushed against the securing protrusion of the supporting part.

The shielding case may further has an engagement part disposed on a lateral side of the hole, and the supporting part also has an engagement hook disposed corresponding to the engagement part. The supporting part is positioned on the shielding case by engaging the engagement hook with the engagement part. The above-mentioned AD adapter module can be used in a flat panel display in order to transform AC power into DC power for the flat panel display. In addition, the above-mentioned AD adapter device may be a power board.

Other objects, features, and advantages of the invention will become apparent from the following detailed description of the preferred but non-limiting embodiments. The following description is made with reference to the accompanying drawings.

DETAILED DESCRIPTION OF THE INVENTION

The invention will be described with reference to a preferred embodiment; however, the embodiment does not intend to restrict the protection range of the invention. The embodiment in this description only directs to an AD adapter module made under the spirit of the invention. Hereinafter, the technological features of the invention will be described in detail.

Figure 1:
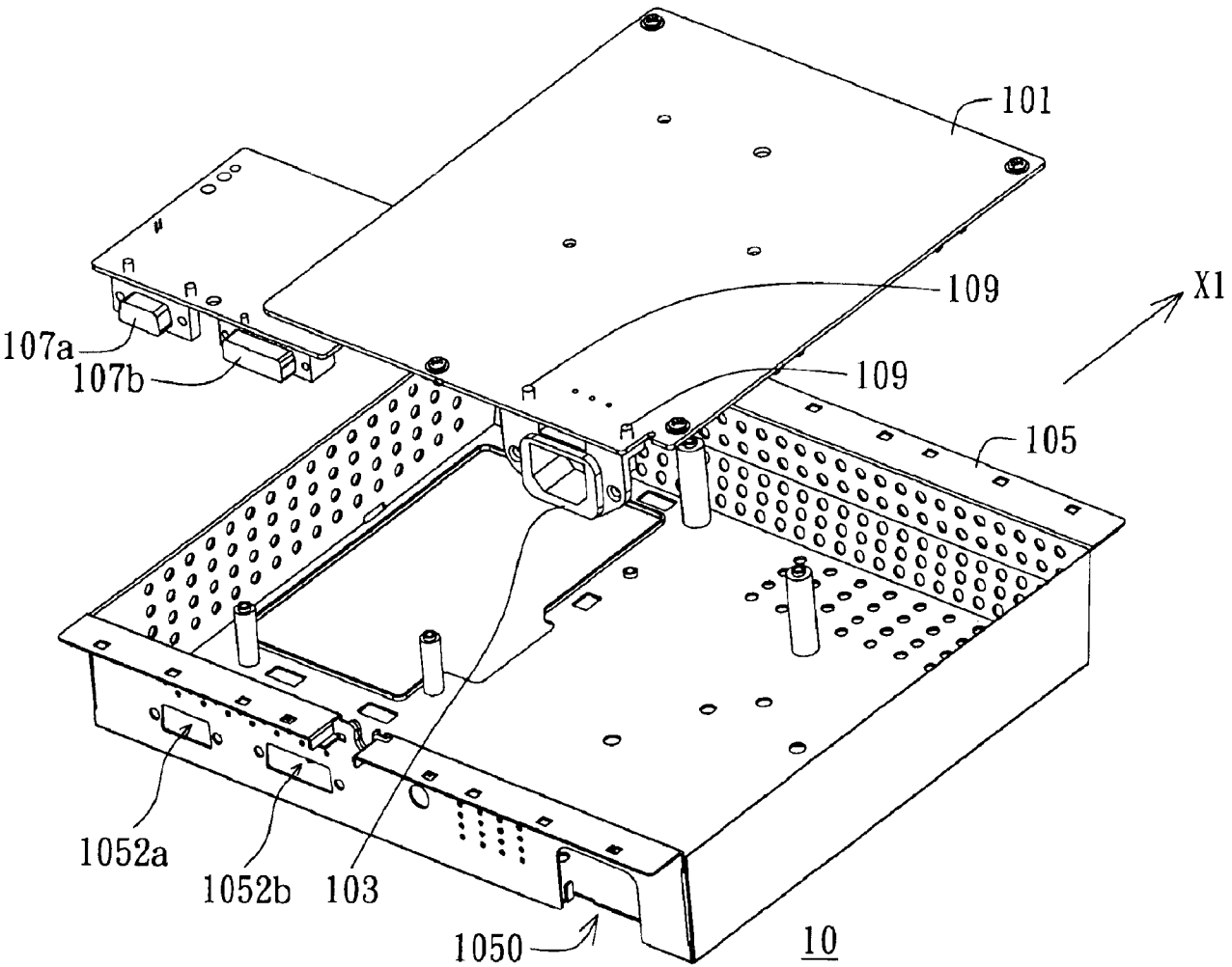
FIG. 1(PRIOR ART)
FIG. 1 is a schematic illustration showing a conventional power board module.
Figure 2:
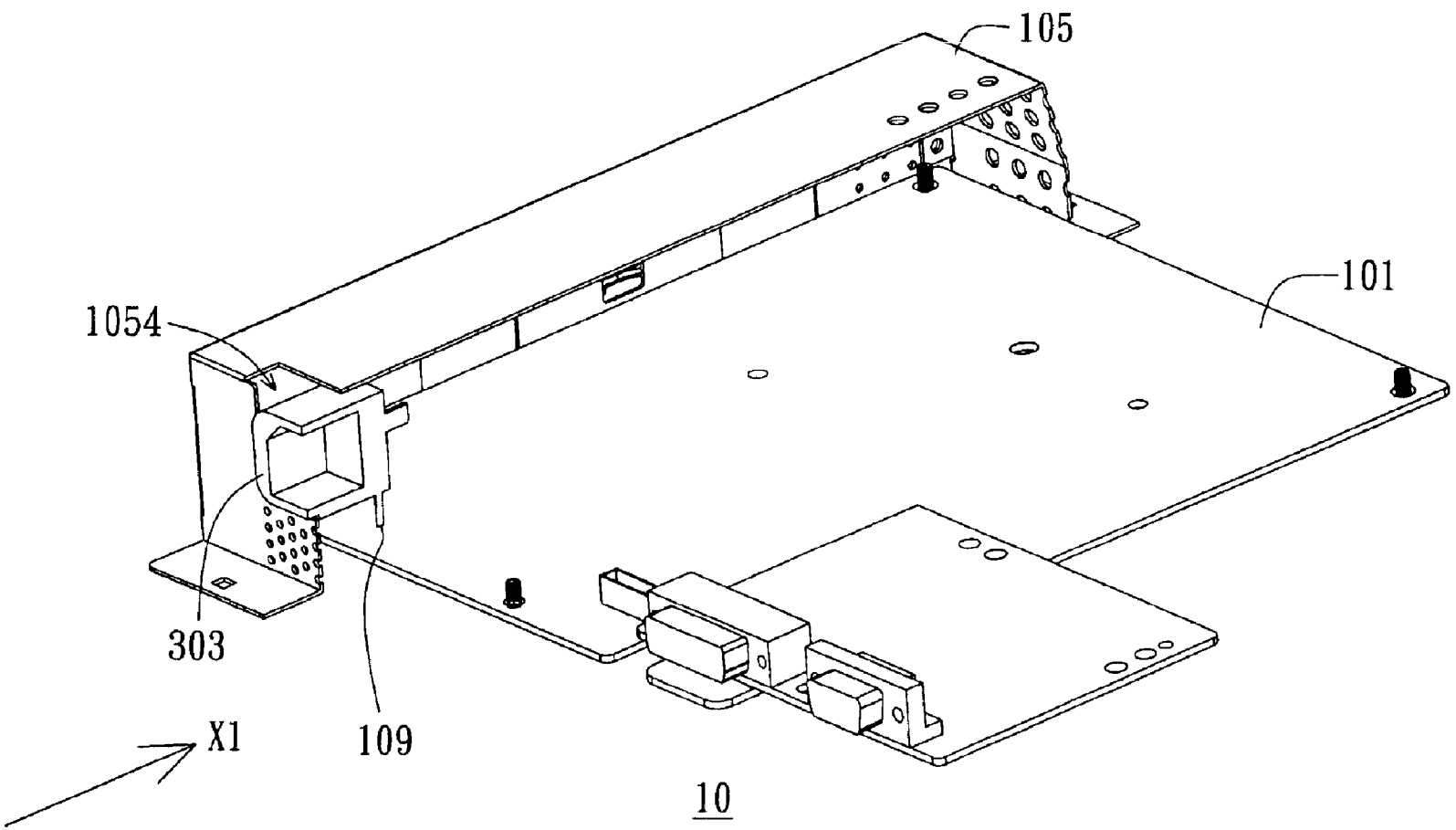
FIG. 2(PRIOR ART)
FIG. 2 is a schematic illustration showing the assembly of a power board and a shielding case.
Figure 3:
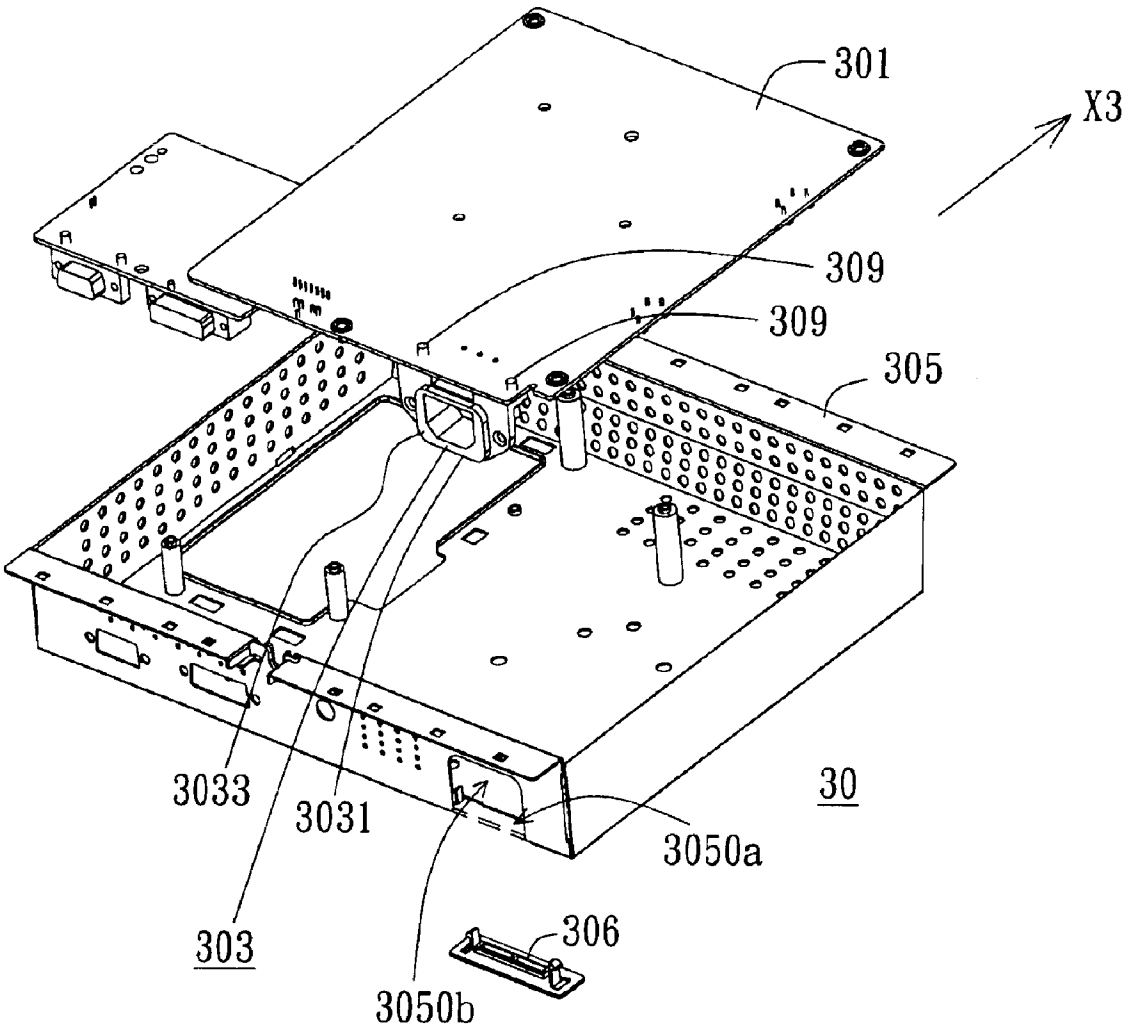
FIG. 3 is a schematic illustration showing a power board module according to a preferred embodiment of the invention.

FIG. 3 is a schematic illustration showing a power board module according to a preferred embodiment of the invention. The power board module 30 is used in conjunction with a plug. The power board module 30 may be used in a flat panel display in order to transform AC power to DC power for the flat panel display. The power board module 30 includes an AD adapter device such as a power board 301, a socket 303, a shielding case 305, and a supporting part 306. The socket 303 is to be inserted by the plug of a power line.

Figure 4:
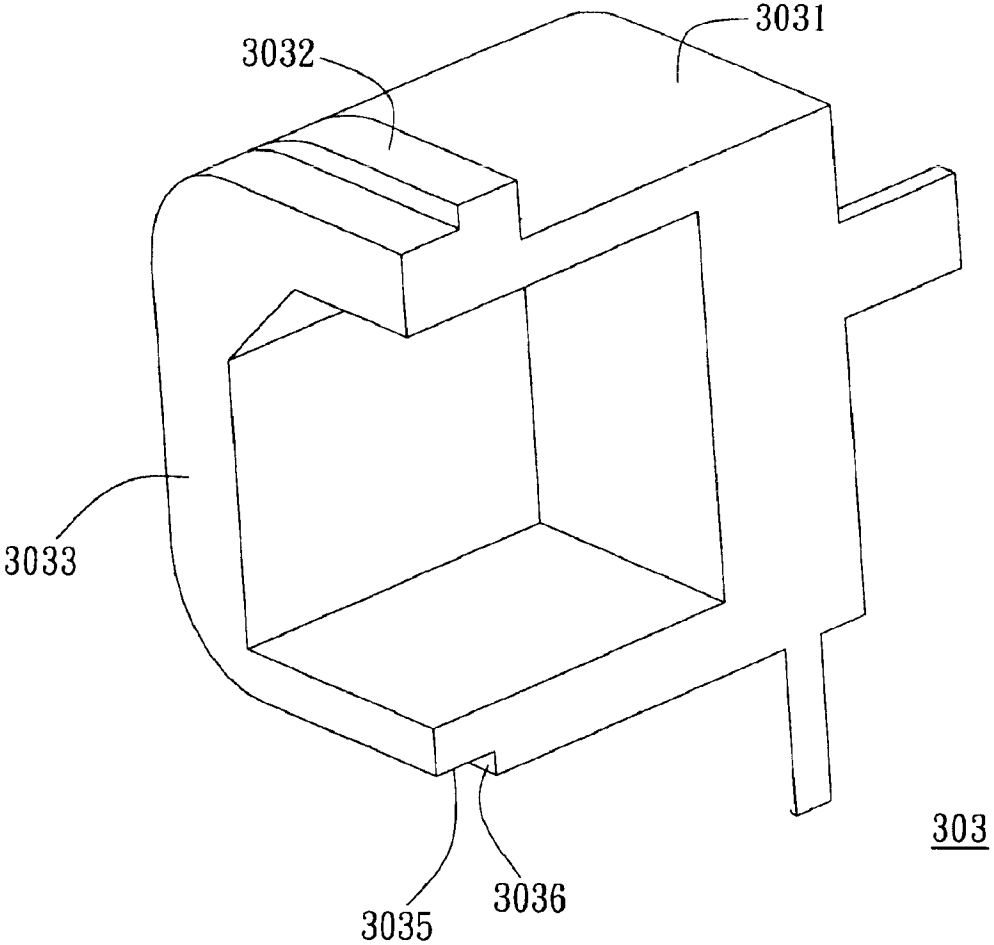
FIG. 4 is a cross-sectional view showing a socket.

FIG. 4 is a cross-sectional view showing a socket. The socket 303 has at least a lateral side. In this embodiment, as shown in FIG. 4, the socket 303 has a first side 3031, a second side 3033, and a third side 3035. A side protrusion 3032 is disposed on the first side 3031 and a stop part 3036 is disposed on the third side 3035. As shown in FIG. 3, the socket 303 is typically welded to the power board 301.

Figure 5:
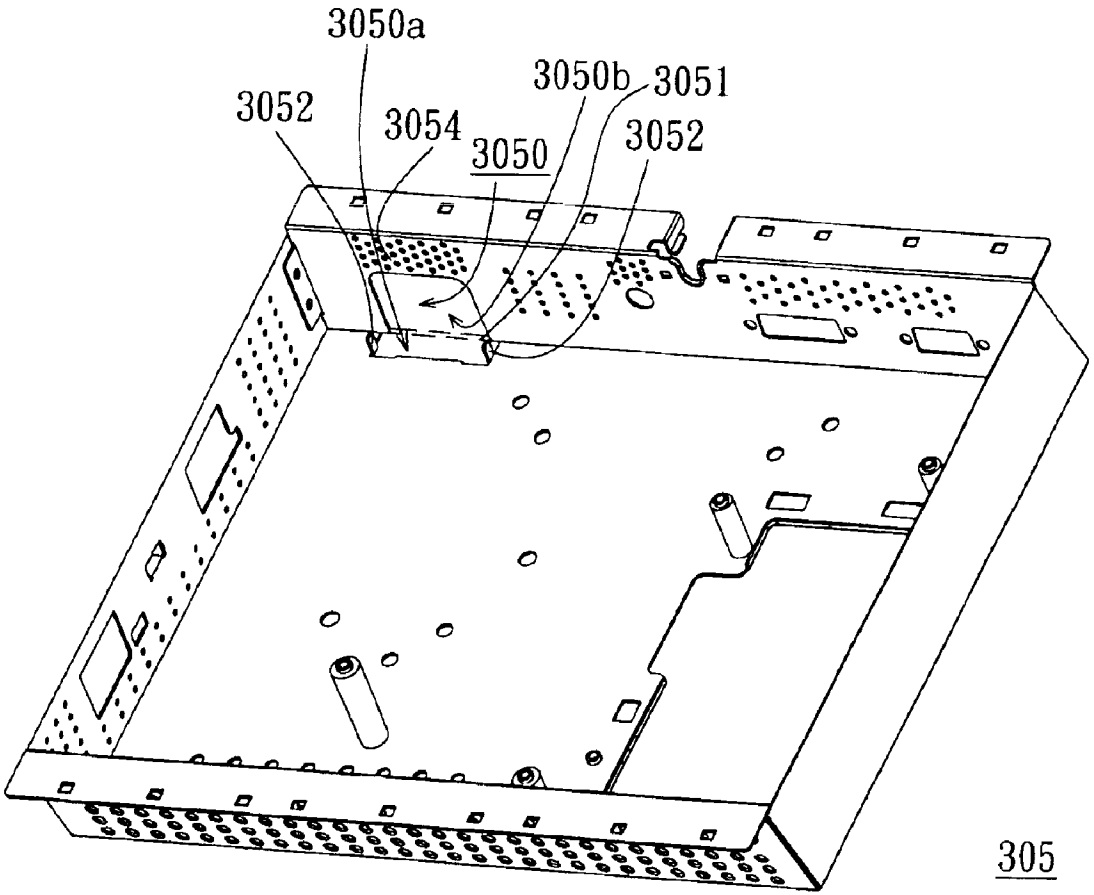
FIG. 5 is a schematic illustration showing a shielding case.

FIG. 5 is a schematic illustration showing a shielding case. The shielding case 305 of a power circuit module has a hole 3050 penetrating the shielding case 305. The hole 3050 of the shielding case 305 may exist individually or may be divided into a first hole 3050*a* and a second hole 3050*b* by a dashed-line region 3051. The dashed-line region 3051 may be a portion of the shielding case 305 for separating the first hole 3050*a* from the second hole 3050*b*. In addition, the shielding case 305 further has two engagement parts 3052 and a second hole sidewall 3054 at the second hole 3050*b*. The engagement parts 3052 are disposed on the lateral side of the first hole 3050*a*. As shown in FIG. 3, the power board 301 is disposed within the shielding case 305 so that the first side 3031 and the second side 3033 of the socket 303 may be exposed from the first hole 3050*a* and the second hole 3050*b*, wherein the side protrusion 3032 of the socket 303 is positioned opposite the first hole 3050*a*.

Figure 6:
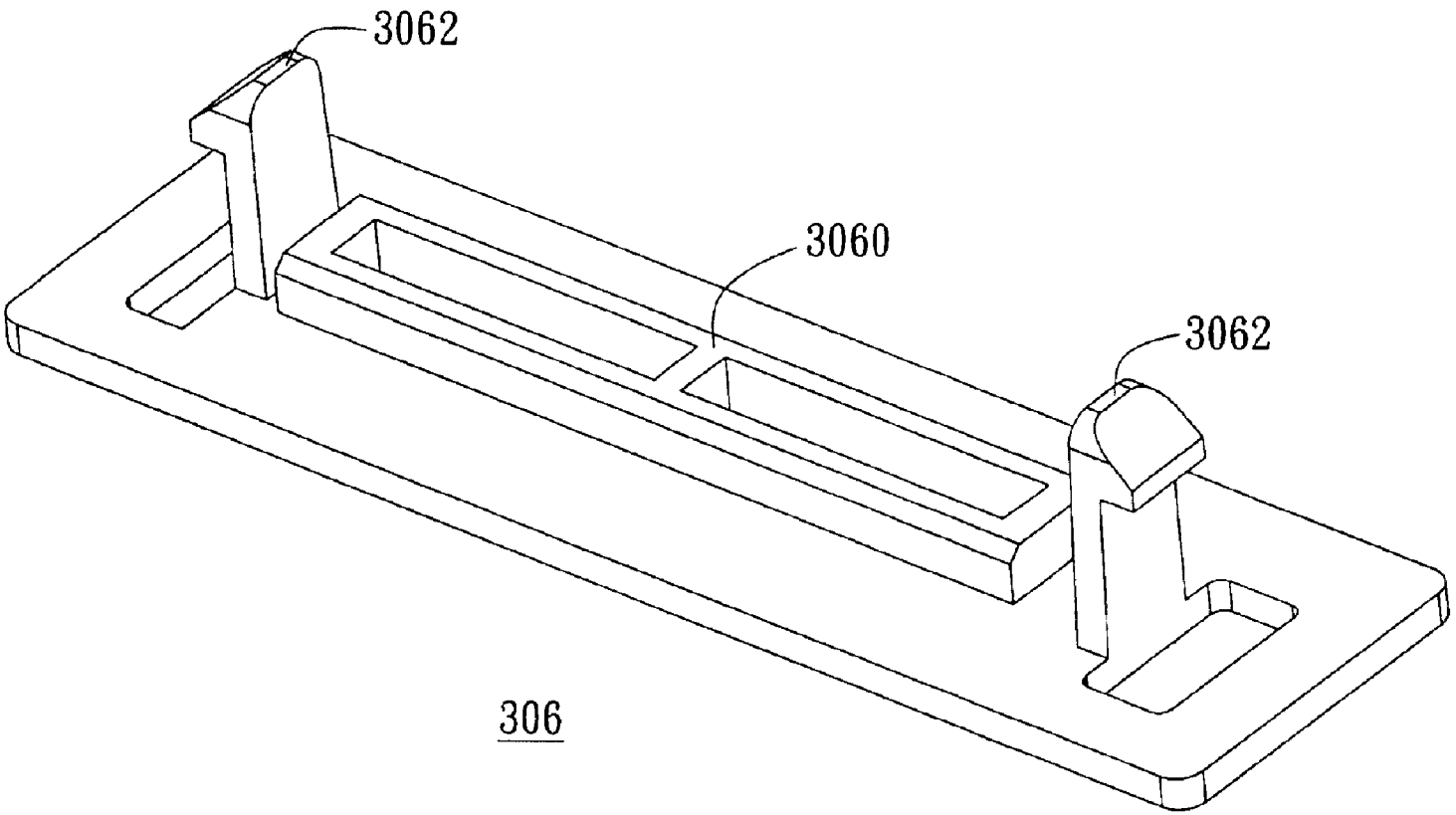
FIG. 6 is a schematic illustration showing a supporting part.

FIG. 6 is a schematic illustration showing a supporting part. One of the features of the invention is characterized in the existence of the supporting part 306. The supporting part 306 has a securing protrusion 3060 and two engagement hooks 3062. The engagement hooks 3062 are disposed corresponding to the engagement parts 3052 of FIG. 5. The supporting part 306 is positioned on the shielding case 305 when the engagement hooks 3062 are engaged with the engagement parts 3052.

Figure 7A:
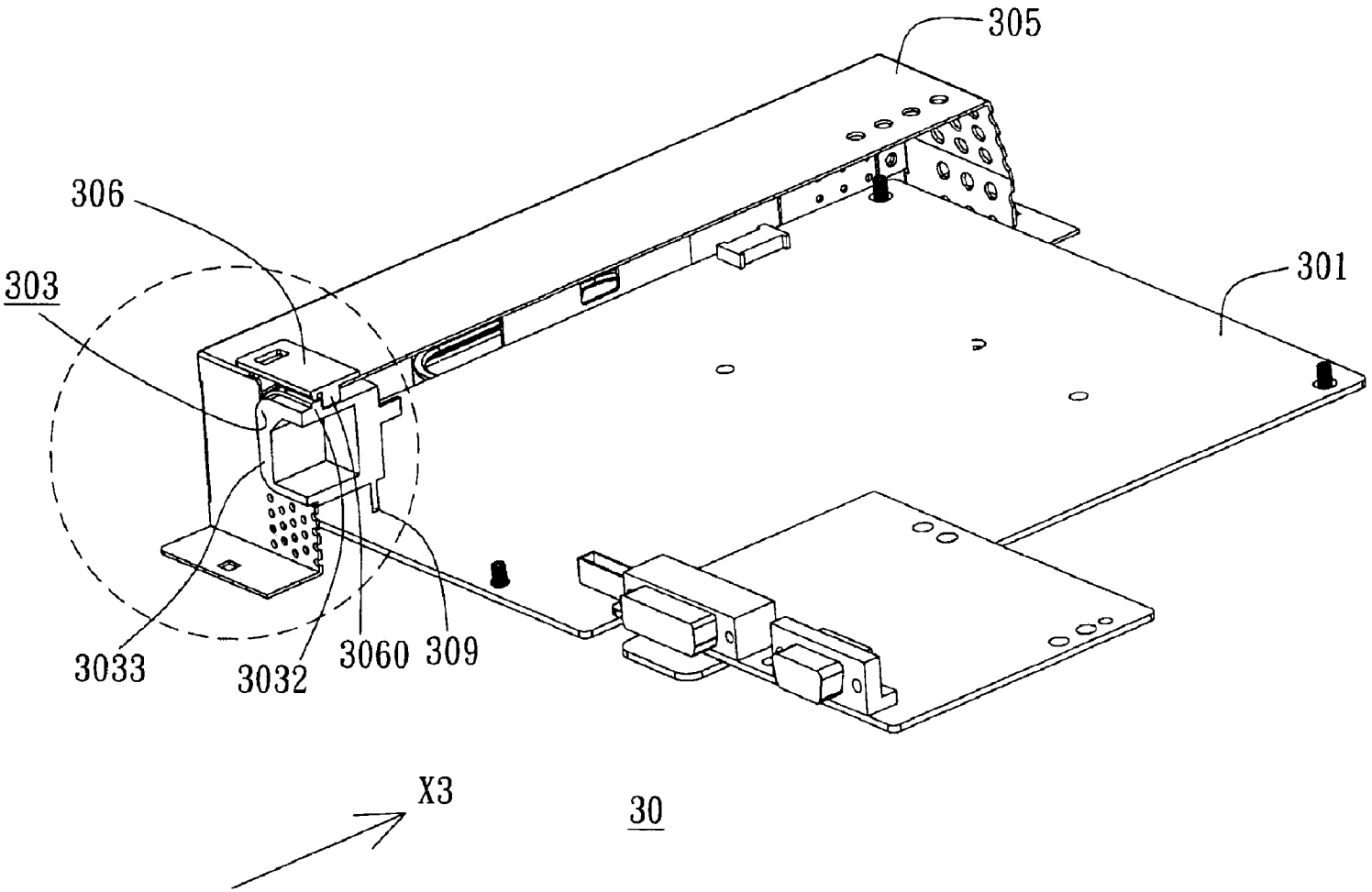
FIG. 7A is a schematic illustration showing an assembly of the power board, the shielding case, and the supporting part.
Figure 7B:
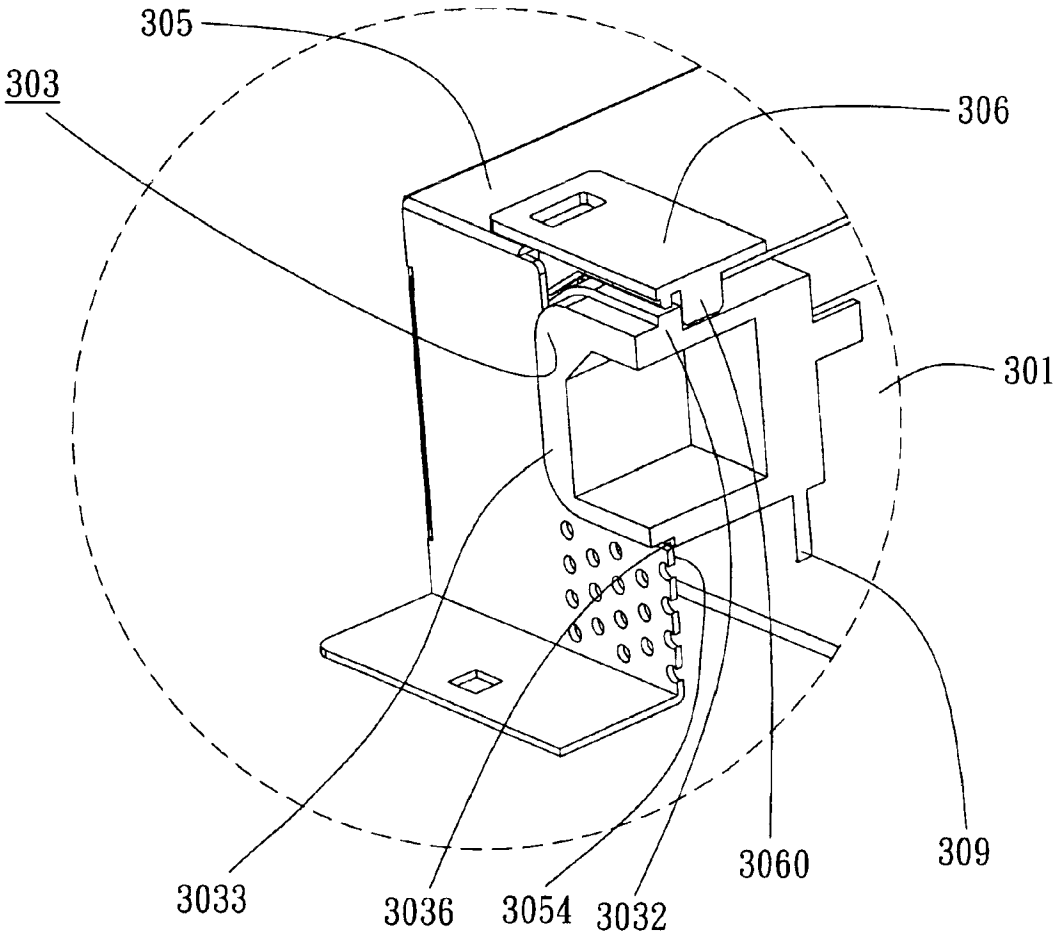
FIG. 7B is a partial schematic illustration of FIG. 7A.

Please refer to FIGS. 7A and 7B. FIG. 7A is a schematic illustration showing the assembly of the power board, the shielding case, and the supporting part. FIG. 7B is a partial schematic illustration of FIG. 7A. FIG. 7A is a cross-sectional view taken along a line passing through the socket 303, the shielding case 305, and the supporting part 306 after the power board 301, the shielding case 305, and the supporting part 306 of FIG. 3 are combined and rotated 180 degrees along the X3 direction.

The supporting part 306 is disposed on the shielding case 305 and the engagement hooks 3062 of the supporting part 306 are engaged with the engagement parts 3052 of the shielding case 305 (as shown in FIGS. 5 and 6) in order to connect the supporting part 306 to the shielding case 305. Hence, the supporting part 306 and the shielding case 305 can be assembled quite easily on the production line. The securing protrusion 3060 of the supporting part 306 is inserted into the first hole 3050a of the shielding case 305, and the securing protrusion 3060 makes contact with the side protrusion 3032 and the shielding case 305.

When the plug is inserted into the socket 303 from the second side 3033 of the socket 303, the side protrusion 3032 is pushed against the securing protrusion 3060, and the securing protrusion 3060 is further pushed against the shielding case 305 so as to enhance the strength of the socket 303 for sustaining external forces. Hence, the solder crack cannot occur easily at the welded portion 309 between the socket 303 and the power board 301, and the socket 303 and the power board 301 cannot be separated.

Furthermore, as shown in FIG. 7B, the stop part 3036 of the socket 303 can make contact with the second hole sidewall 3054 of the shielding case 305. When the plug is pulled out of the socket 303, the stop part 3036 is pulled against the second hole sidewall 3051 so as to fix the socket 303 to the power board 301 firmly.

Figure 8:
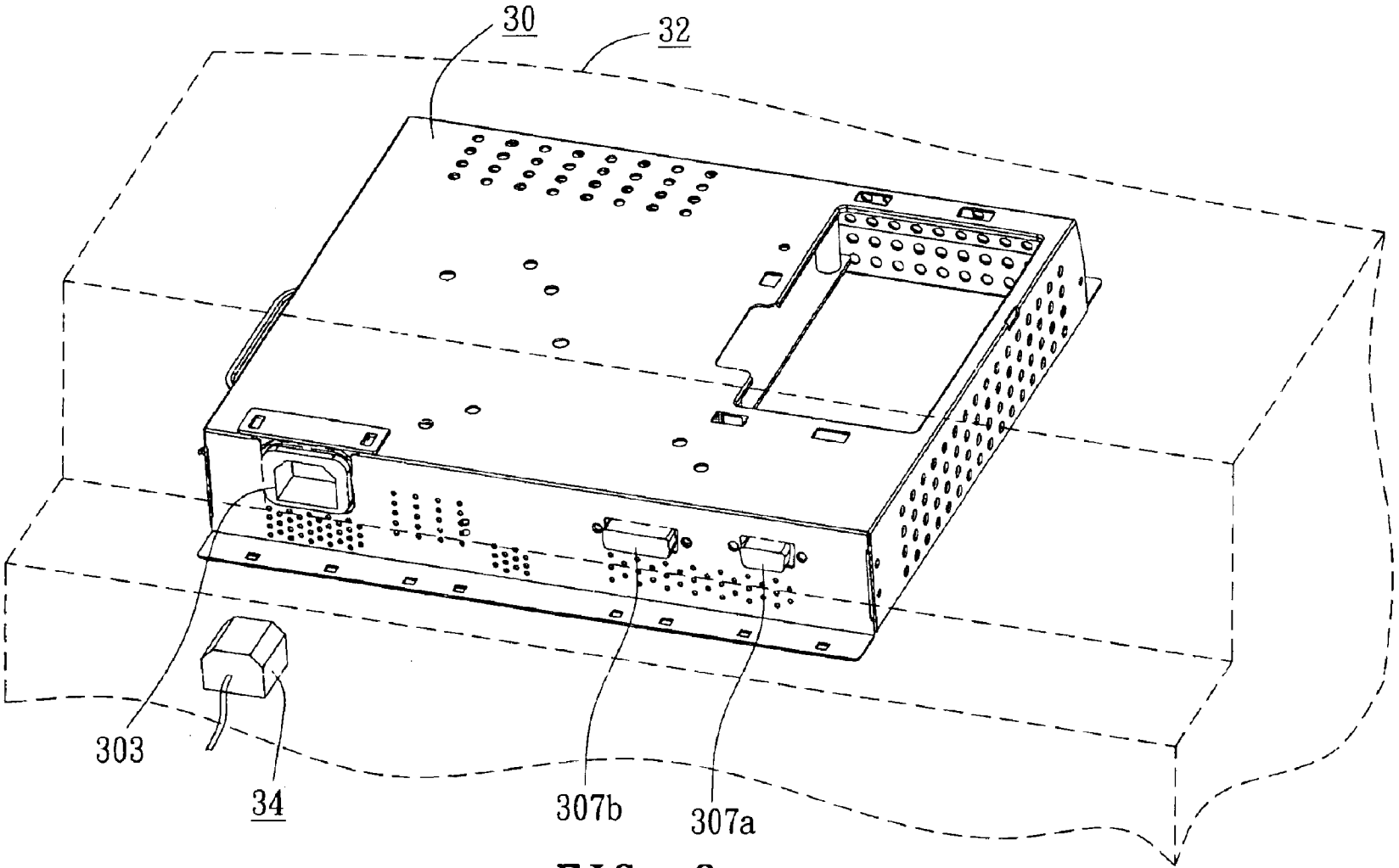
FIG. 8 is a schematic illustration showing the power board module installed in a flat panel display.

FIG. 8 is a schematic illustration showing the power board module installed in the flat panel display. The region defined by the dashed lines represents the outline of the flat panel display 32, and the assembled power board module 30 is disposed within the flat panel display 32. The socket 303 and connectors 307*a* and 307*b* on the power board module 30 are to be exposed to the outside of the flat panel display 32 through the predetermined holes that are preserved on the flat panel display 32, so that the plug 34 may be connected to the socket 303 and other wires may be connected to the connectors 307*a* and 307*b*.

It can be known from the above description that the supporting part 306 of the power board module 30 of this embodiment is disposed on the shielding case 305 so that the securing protrusion 3060 on the supporting part 306 may make contact with the side protrusion 3032 on the socket 303 and the shielding case 305. Consequently, when the plug of the power line is inserted into the socket 303 along the X3 direction of FIG. 7A, the strength of the socket 303 for sustaining external forces increases, and the solder crack cannot occur easily at the welded portion 309 between the socket 303 and the power board 301. Meanwhile, the short-circuited phenomenon cannot easily occur between the socket 303 and the power board 301.

While the invention has been described by way of examples and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An AD adapter module, comprising:

an AD adapter device;

a socket disposed on the AD adapter device, the socket comprising a lateral side with a side protrusion on the lateral side;

a shielding case having a hole penetrating the shielding case, the AD adapter device being disposed within the shielding case with the lateral side of the socket and the side protrusion exposed from the hole; and a supporting part comprising a securing protrusion, the supporting part being disposed on the shielding case, the securing protrusion being inserted into the hole of the shielding case to make the securing protrusion contact the side protrusion and the shielding case, wherein the securing protrusion of the supporting part is pushed against the side protrusion of the socket when a plug is inserted into the socket.

2. The AD adapter module according to claim 1, wherein:

the shielding case further comprises an engagement part disposed on the lateral side of the hole; and the supporting part further comprises an engagement hook disposed corresponding to the engagement part, and the supporting part is positioned on the shielding case by engaging the engagement hook with the engagement part.

3. The AD adapter module according to claim 1, wherein the AD adapter module is used in a flat panel display, and the AD adapter module transforms an AC power into a DC power for the flat panel display.

4. The AD adapter module according to claim 1, wherein the AD adapter device is a power board.

5. An AD adapter module, comprising:

a power board;

a socket disposed on the power board, the socket comprising a lateral side with a side protrusion on the lateral side;

a shielding case having a hole and an engagement part, wherein the hole penetrates the shielding case, the power board is disposed within the shielding case so the lateral side of the socket and the side protrusion are exposed from the hole; and a supporting part comprising a securing protrusion and an engagement hook, the engagement hook being disposed corresponding to the engagement part, the securing protrusion of the supporting part being inserted into the hole of the shielding case so the securing protrusion makes contact with the side protrusion and the shielding case, the engagement hook of the supporting part being engaged with the engagement part of the shielding case so the supporting part is positioned on the shielding case, wherein when a plug is inserted into the socket, the side protrusion of the socket is pushed against the securing protrusion of the supporting part.

6. The AD adapter module according to claim 5, wherein the AD adapter module is used in a flat panel display, and the AD adapter module transforms an AC power into a DC power for the flat panel display.

7. A power board module used in conjunction with a plug, the power board module comprising:

a power board;

a socket, which is to be inserted into by the plug and is disposed on the power board, the socket having a first side, a second side, and a side protrusion on the first side;

a shielding case having a first hole and a second hole, each penetrating the shielding case, wherein the power board is disposed within the shielding case so the second side of the socket is exposed from the second hole, and the side protrusion of the socket is positioned opposite the first hole; and a supporting part having a securing protrusion connected to the shielding case, the securing protrusion being inserted into the first hole so that the securing protrusion makes contact with the shielding case and the side protrusion, wherein the securing protrusion is pushed against the side protrusion to prevent the socket separating from the power board when the plug is inserted into the socket from the second side of the socket.

8. The power board module according to claim 7, wherein:

the shielding case further has an engagement part disposed on a lateral side of the first hole; and the supporting part further has an engagement hook disposed corresponding to the engagement part, wherein the supporting part is positioned on the shielding case by engaging the engagement hook with the engagement part.

9. The power board module according to claim 7, wherein:

the socket further has a third side and a stop part disposed on the third side; and the shielding case further has a second hole sidewall at the second hole, wherein the stop part contacts the second hole sidewall, and the stop part is pulled against the second hole sidewall when the plug is pulled out of the socket so the socket stays firmly on the power board.

10. The power board module according to claim 7, wherein the power board module is used in a flat panel display and transforms an AC power into a DC power for the flat panel display.

* * * * *